US007080465B2

(12) United States Patent
Fujinami et al.

(10) Patent No.: US 7,080,465 B2
(45) Date of Patent: Jul. 25, 2006

(54) METHOD OF MANUFACTURING INKJET RECORDING SHEET AND DRYING APPARATUS FOR APPLICATION FILM

(75) Inventors: Tatsuya Fujinami, Fujinomiya (JP); Yutaka Kashiwabara, Fujinomiya (JP); Katsuhiko Takada, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 126 days.

(21) Appl. No.: 10/793,244

(22) Filed: Mar. 5, 2004

(65) Prior Publication Data

US 2004/0181967 A1 Sep. 23, 2004

(30) Foreign Application Priority Data

Mar. 7, 2003 (JP) ..... 2003-061643

(51) Int. Cl.
*F26B 13/06* (2006.01)

(52) U.S. Cl. ..... 34/619; 34/621; 34/629; 34/633

(58) Field of Classification Search ..... 34/448, 34/611, 613, 619, 621, 629, 633, 641, 643
See application file for complete search history.

(56) References Cited

U.S. PATENT DOCUMENTS 4,467,537 A * 8/1984 Trotscher ..... 34/635
5,333,395 A * 8/1994 Bulcsu ..... 34/79
5,912,085 A * 6/1999 Ito et al. ..... 428/500

FOREIGN PATENT DOCUMENTS

JP 11-091238 A 4/1999
JP 11-348412 A 12/1999
JP 2001-88439 * 4/2001

* cited by examiner

*Primary Examiner*—S. Gravini
(74) *Attorney, Agent, or Firm*—Sughrue Mion, PLLC

(57) ABSTRACT

The present invention dries an ink absorption layer using a drying apparatus after applying an ink absorption layer application liquid containing inorganic particles and water-soluble resin to a continuously running web and thereby reduces a drying speed distribution in the width direction of the ink absorption layer to 20% or less.

9 Claims, 7 Drawing Sheets

METHOD OF MANUFACTURING INKJET RECORDING SHEET AND DRYING APPARATUS FOR APPLICATION FILM

BACKGROUND OF THE INVENTION

1. Field of the Invention

The present invention relates to a method of manufacturing inkjet recording sheets and a drying apparatus for an application film, and more particularly, to a drying apparatus suitable for drying an ink absorption layer when inkjet recording sheets are manufactured.

2. Description of the Related Art

A step of drying an application film formed after an application liquid is applied to a continuously running web is widely used in the field of manufacturing various application products such as a photographic film, magnetic recording medium and inkjet recording sheets, etc., and is an important step which affects the quality of a product. Especially in the step of drying an ink absorption layer (also called "porous layer" or "color material receptor layer") when inkjet recording sheets are manufactured, it is well known that the ink absorption layer is generally liable to cracking in a falling rate drying step.

For example, Japanese Patent Application Publication No. 11-348412 describes a problem that when applying a cross-linker, an excessively low water content of an ink absorption layer results in cracking, product loss, causing cracked application film pieces to drop in the step which causes contamination of the step, while an excessively high water content of an ink absorption layer results in the surface of the application film becoming as rough as orange peel. This document discloses a countermeasure which performs drying before the color material receptor layer starts to indicate a falling rate drying speed in such a way that the concentration of a solid content in the ink absorption layer falls within a range of 15 to 40 weight percent.

Furthermore, Japanese Patent Application Publication No. 11-91238 describes that when a large amount of liquid is applied, if drying is performed under a condition of air blowing, part with a non-uniform surface of the application surface contracts differently during drying, which is likely to produce cracking during drying. The document discloses a countermeasure which performs drying with substantially no air blowing until the concentration of the application liquid of the ink absorption layer exceeds 25 weight percent.

However, the problem is that even the drying methods described in Japanese Patent Application Publication No. 11-348412 and Japanese Patent Application Publication No. 11-91238 cannot completely prevent cracking in the ink absorption layer. Drying defects such as cracking, especially fissures or surface roughness may occur at both ends in the direction of the web width of the ink absorption layer and how to prevent these defects is an issue to be addressed.

Furthermore, the measures for preventing drying defects in the width direction of the application film is not limited to an ink absorption layer, and they apply to application films in general and there is a demand for a drying apparatus capable of preventing drying defects in the width direction of the application film.

SUMMARY OF THE INVENTION

The present invention has been developed in view of the circumstances described above and it is an object of the present invention to provide a method of manufacturing inkjet recording sheets free of cracking or surface roughness during drying of an ink absorption layer and a drying apparatus for an application film capable of preventing drying defects in the width direction of the application film.

The present inventor noticed that in a drying process of an application film such as an ink absorption film, when a drying speed distribution is produced in various parts of the application film, the contraction speed varies from one part to another of the application film, large stress is applied to the application film, which is likely to produce fissures. Furthermore, in the case of a general drying apparatus provided with a blowout nozzle which blows hot air toward the application film side bordering a dry zone web and an exhaust port opposite to the application film surface, the hot air blown out of the blowout nozzle forms a flow which collides with the surface of the application film and then escapes toward both ends in the web width direction, wraps around the back side of the web and is exhausted through the exhaust port. The present inventor noticed that this would cause the hot air to be accumulated at both ends in the web width direction of the application film and cause drying to proceed more quickly at both ends than in the central area, causing fissures to be easily produced due to a drying speed distribution. Furthermore, it has also been found that if the drying speed distribution in the web width direction of the application film could be suppressed to 20% or below, fissures would be less likely to occur. Based on such knowledge, the present invention provides a method of manufacturing inkjet recording sheets and a drying apparatus which hardly produces a drying speed distribution in the web width direction.

In order to attain the above described object, a first aspect of the present invention is a method of manufacturing inkjet recording sheets, comprising the drying step of drying an ink absorption layer after an ink absorption layer application liquid containing inorganic particles and water-soluble resin is applied to a continuously running web, wherein in the drying step, the drying speed distribution in the web width direction of the ink absorption layer is limited to within 20%.

Here, the "drying speed distribution in the web width direction of the ink absorption layer (application film) being 20% or less" means that an increasing rate of the maximum drying speed with respect to the minimum drying speed in the web width direction is a maximum of 20%, and the minimum drying speed is normally measured in the central area in the web width direction of the application film while the maximum drying speed is measured at both ends in the web width direction.

According to the first aspect of the present invention, drying is performed in such a way that the drying speed distribution in the web width direction of the ink absorption layer falls below 20%, and therefore it is possible to prevent drying defects such as cracking and surface roughness from occurring at both ends in the web width direction of the ink absorption layer. In this case, it is more preferable to reduce the drying speed distribution in the web width direction of the ink absorption layer to 15% or below.

In order to attain the above described object, a second aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone, including a plurality of blowout nozzles having slot-shaped air outlets in the web width direction arranged from the inlet to the outlet at certain intervals and a space recessed from the tip of the blowout nozzle between the neighboring blowout nozzles and an exhaust section provided opposite to the application film surface bordering the web in the drying zone which exhausts the hot air blown out of the blowout nozzles, wherein when a longitudinal cross-sectional area viewed from the web running direction of the space is S ($m^2$) and an amount of hot air blown out of the blowout nozzles is V ($m^3$/min) per 1 m of the length in the web width direction of the blowout nozzles, the relationship between the longitudinal cross-sectional area and amount of air is formed in such a way that the value of (S/V)×1000 is 0.5 or above.

The second aspect of the present invention shows an example of the drying apparatus for drying so that the drying speed distribution in the web width direction of the application film is 20% or less. That is, by increasing the spatial capacity with respect to the amount of air blown out of the blowout nozzles so that the value of (S/V)×1000 is 0.5 or above, the hot air which is blown from the blowout nozzles and collides with the surface of the application film is allowed to easily escape into space. This makes the formation of a flow of hot air which escapes toward both ends in the web width direction after colliding with the surface of the application film less likely to occur and even if such a flow is formed, the amount of air (wind speed) decreases. Therefore, the percentage of hot air accumulated at both ends of the web decreases and it is thereby possible to suppress the drying speed distribution in the web width direction of the application film to 20% or less.

In order to attain the above described object, a third aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone including a plurality of blowout nozzles having slot-shaped air outlets in the web width direction arranged from the inlet to the outlet at certain intervals and an exhaust device which exhausts the hot air blown out of the blowout nozzles from above the surface of the application film.

The third aspect of the present invention shows another example of the drying apparatus for drying in such a way that the drying speed distribution in the web width direction of the application film is 20% or below. That is, exhausting hot air blown out of the blowout nozzles from above the film surface of the application film makes the formation of a flow of hot air which escapes toward both ends in the web width direction after colliding with the surface of the application film less likely to occur and even if such a flow is formed, the amount of air decreases. Thus, the amount of hot air accumulated at both ends of the web decreases, and it is thereby possible to suppress the drying speed distribution in the web width direction of the application film to 20% or below.

A fourth aspect of the present invention is based on the third aspect of the present invention, wherein the hot air blowout section has a space recessed from the tip of the blowout nozzles between the neighboring blowout nozzles and air in the space is exhausted by the exhaust device.

This is intended to actively exhaust the hot air which has escaped into the space after being blown out of the blowout nozzles and colliding with the surface of the application film and make it further easier for the hot air which has collided with the surface of the application film to escape into the space. Therefore, this makes the formation of a flow of hot air which escapes toward both ends in the web width direction after colliding with the surface of the application film less likely to occur and even if such a flow is formed, the amount of air decreases. Thus, the amount of hot air accumulated at both ends of the web decreases, and it is thereby possible to suppress the drying speed distribution in the web width direction of the application film to 20% or below.

In order to attain the above described object, a fifth aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone including a plurality of blowout nozzles having slot-shaped air outlets in the web width direction arranged from the inlet to the outlet at certain intervals and an exhaust section provided opposite to the surface of the application film bordering the web in the drying zone which exhausts the air in the drying zone, wherein the area of the opening of the slot-shaped air outlets of the blowout nozzles is smaller at both ends than in the central area in the web width direction.

The fifth aspect of the present invention shows a further example of the drying apparatus for drying in such a way that the drying speed distribution in the web width direction of the application film is 20% or below. This is intended to cause the area of the opening of the air outlets of the blowout nozzles to vary with the anticipation that a flow of hot air which escapes towards both ends in the web width direction after colliding with the surface of the application film is formed and the hot air is accumulated at both ends of the web. That is, making the area of the opening of the slot-shaped air outlets of the blowout nozzles smaller at both ends than in the central area in the web width direction causes the amount of air blown out toward both ends in the web width direction of the application film to be smaller than the amount of air blown out into the central area, and therefore even if the hot air at both ends of the application film is accumulated, it is possible to reduce the difference in air quantity between both ends and central area. This makes it possible to reduce the difference in the drying speed distribution between both ends and central area and thereby suppress the drying speed distribution in the web width direction of the application film to 20% or below.

In order to attain the above described object, a sixth aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone, including a plurality of blowout nozzles having slot-shaped air outlets in the web width direction arranged from the inlet to the outlet at equal intervals and a space recessed from the tip of the blowout nozzles between the neighboring blowout nozzles and an exhaust section provided opposite to the application film surface bordering the web in the drying zone which exhausts the air in the drying zone, wherein when a longitudinal cross-sectional area viewed from the web running direction of the space is S ($m^2$) and an amount of hot air blown out of the blowout nozzles is V ($m^3$/min) per 1 m of the length in the web width direction of the blowout nozzles, the relationship between the longitudinal cross-sectional area and amount of air is formed in such a way that the value of (S/V)×1000 is 0.5 or above and the area of the opening of the slot-shaped air outlets of the blowout nozzles is smaller at both ends than in the central area in the web width direction.

The sixth aspect of the present invention shows a still further example of the drying apparatus for drying in such a way that the drying speed distribution in the web width direction of the application film is 20% or below and satisfies both the configuration requirement that the above described value of (S/V)×1000 is 0.5 or above and the configuration requirement that the area of the opening of the slot-shaped air outlets of the blowout nozzles is smaller at both ends than in the central area in the web width direction.

In order to attain the above described object, a seventh aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone, including a plurality of blowout nozzles having slot-shaped air outlets in the web width direction arranged from the inlet to the outlet at equal intervals and a space recessed from the tip of the blowout nozzles between the neighboring blowout nozzles and an exhaust device which exhausts air in the space, wherein when a longitudinal cross-sectional area viewed from the web running direction of the space is S ($m^2$) and an amount of hot air blown out of the blowout nozzles is V ($m^3$/min) per 1 m of the length in the web width direction of the blowout nozzles, the relationship between the longitudinal cross-sectional area and amount of air is formed in such a way that the value of (S/V)×1000 is 0.5 or above.

The seventh aspect of the present invention shows a still further example of the drying apparatus for drying in such a way that the drying speed distribution in the web width direction of the application film is 20% or below and satisfies both the configuration requirement of providing an exhaust device which exhausts air in the space and the configuration requirement that the above described value of (S/V)×1000 is 0.5 or above.

In order to attain the above described object, an eighth aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone, including a plurality of blowout nozzles having slot-shaped air outlets in the web width direction arranged from the inlet to the outlet at equal intervals and a space recessed from the tip of the blowout nozzles between the neighboring blowout nozzles and an exhaust device which exhausts air in the space, wherein the area of the opening of the slot-shaped air outlets of the blowout nozzles is smaller at both ends than in the central area in the web width direction.

The eighth aspect of the present invention shows a still further example of the drying apparatus for drying in such a way that the drying speed distribution in the web width direction of the application film is 20% or below and satisfies both the configuration requirement of providing an exhaust device which exhausts air in the space and the configuration requirement that the area of the opening of the slot-shaped air outlets of the blowout nozzles is smaller at both ends than in the central area in the web width direction.

In order to attain the above described object, a ninth aspect of the present invention is a drying apparatus for an application film, which dries an application film applied to and formed on a continuously running web with hot air, comprising a drying apparatus body which forms a tunnel-shaped drying zone where the web is running from the inlet to the outlet, a hot air blowout section provided on the application film side bordering the web in the drying zone, including a plurality of blowout nozzles having slot-shaped air outlets in the web width direction arranged from the inlet to the outlet at equal intervals and a space recessed from the tip of the blowout nozzles between the neighboring blowout nozzles and an exhaust device which exhausts air in the space, wherein when a longitudinal cross-sectional area viewed from the web running direction of the space is S ($m^2$) and an amount of hot air blown out of the blowout nozzles is V ($m^3$/min) per 1 m of the length in the web width direction of the blowout nozzles, the relationship between the longitudinal cross-sectional area and amount of air is formed in such a way that the value of (S/V)×1000 is 0.5 or above and the-area of the opening of the slot-shaped air outlets of the blowout nozzles is smaller at both ends than in the central area in the web width direction.

The ninth aspect of the present invention shows a still further example of the drying apparatus for drying in such a way that the drying speed distribution in the web width direction of the application film is 20% or below and satisfies three configuration requirements; the configuration requirement of providing an exhaust device which exhausts air in the above described space, the configuration requirement that the area of the opening of the slot-shaped air outlets of the blowout nozzles is smaller at both ends than in the central area in the web width direction and the configuration requirement that the above described value of (S/V)×1000 is 0.5 or above. A tenth aspect of the present invention is based on the second to ninth aspects of the present invention, wherein the distance from the surface of the web to the tip of the blowout nozzles is within a range of 10 to 100 mm. This is because when the distance from the surface of the web to the tip of the blowout nozzles is as small as 10 to 100 mm, a flow of hot air which escapes toward both ends in the web width direction after colliding with the surface of the application film is easily formed and the drying apparatus for an application film of the present invention is especially effective in such a case.

In order to attain the above described object, an eleventh aspect of the present invention is a method of manufacturing inkjet recording sheets, comprising the step of drying an ink absorption layer after applying an ink absorption layer application liquid containing inorganic particles and water-soluble resin to a continuously running web, wherein any one of the drying apparatuses according to the second to tenth aspects is used in the drying step. Using any one of the drying apparatuses according to the second to tenth aspects makes it possible to suppress the drying speed distribution in the web width direction of the ink absorption layer to 20% or below. This allows manufacturing of inkjet recording sheets free of cracking or surface roughness when the ink absorption layer is dried.

As described above, according to the method of manufacturing inkjet recording sheets of the present invention, it is possible to manufacture inkjet recording sheets free of cracking or surface roughness when the ink absorption layer is dried.

Furthermore, the drying apparatus for an application film of the present invention can make the formation of a drying speed distribution in the application film width direction less likely to occur, and is therefore preferably used for drying an ink absorption layer when manufacturing inkjet recording sheets.

DETAILED DESCRIPTION OF THE PREFERRED EMBODIMENTS

With reference now to the attached drawings, preferred embodiments of a method of manufacturing inkjet recording sheets and a drying apparatus for an application film according to the present invention will be explained in detail below.

Figure 1:
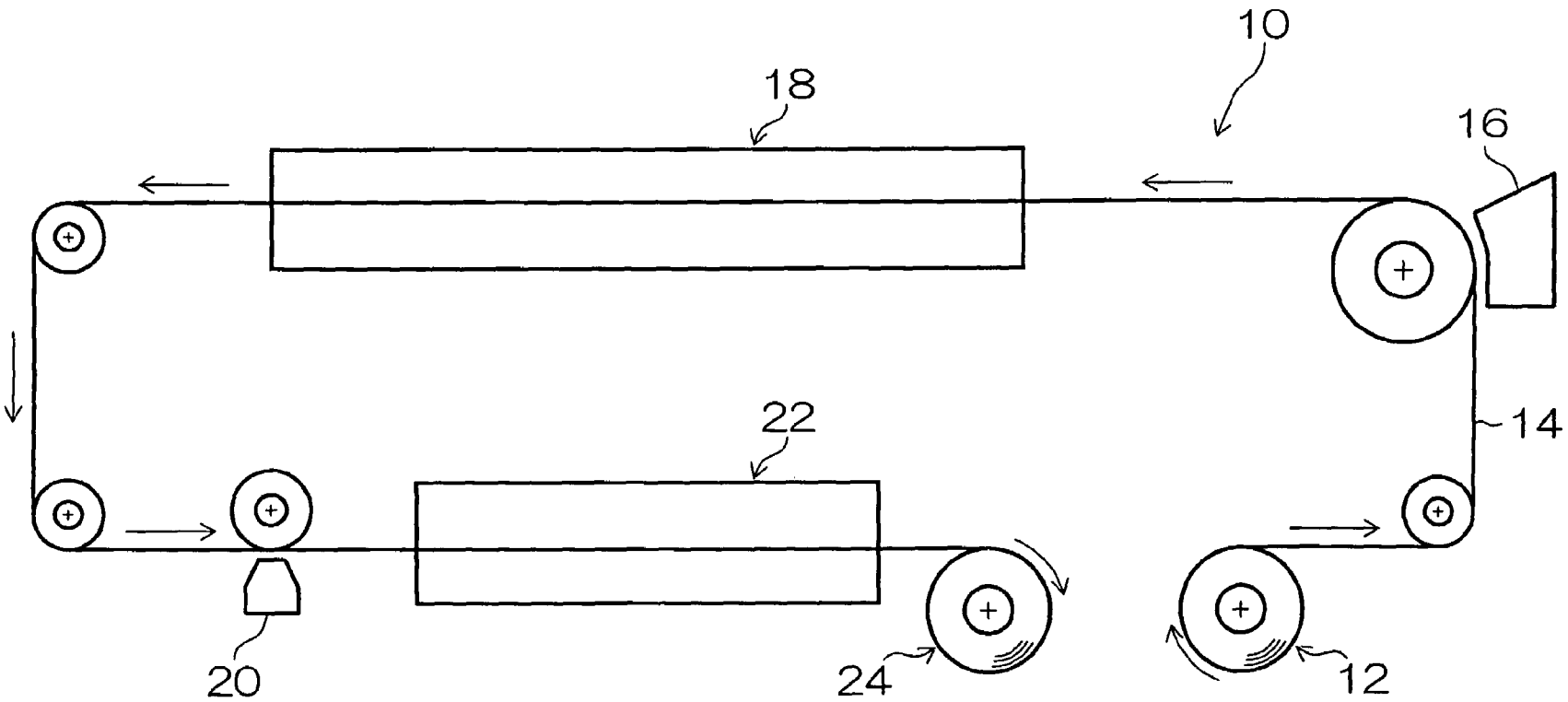
FIG. 1 is a schematic view of an apparatus configuration to which a method of manufacturing inkjet recording sheets of the present invention is applied.

FIG. 1 is a schematic configuration example of a manufacturing apparatus 10 which realizes a method of manufacturing inkjet recording sheets of the present invention and an example of a drying apparatus for an application film of the present invention incorporated as a drying apparatus 18 which dries an ink absorption layer.

As shown in FIG. 1, an ink absorption layer application liquid containing at least inorganic particles and water-soluble resin is applied to a continuously running web 14 which is sent from a feeding apparatus 12 by a first application coater 16 and then a drying apparatus 18 dries the ink absorption layer in a damp-dry state. Here, a preferable damp-dry state of the ink absorption layer is a state in which water content is in a range of 1000 to 300 weight percent (water/solid components). The aforementioned drying apparatus 18 dries the ink absorption layer in such a way that the drying speed distribution in the web width direction of the ink absorption layer is 20% or less or preferably 15% or less.

Then, an application liquid containing a cross-linker is applied wet-on-wet to the ink absorption layer in a damp-dry state by a second application coater 20 and then dried by a drying apparatus 22. An inkjet recording sheet is manufactured in this way and the inkjet recording sheet manufactured is wound by a winding apparatus 24.

The first and second application coaters 16 and 20 are not particularly limited and various application coaters such as a slide bead coater, extrusion coater, roll coater, blade coater and air-knife coater, etc., can be used.

Figure 2:
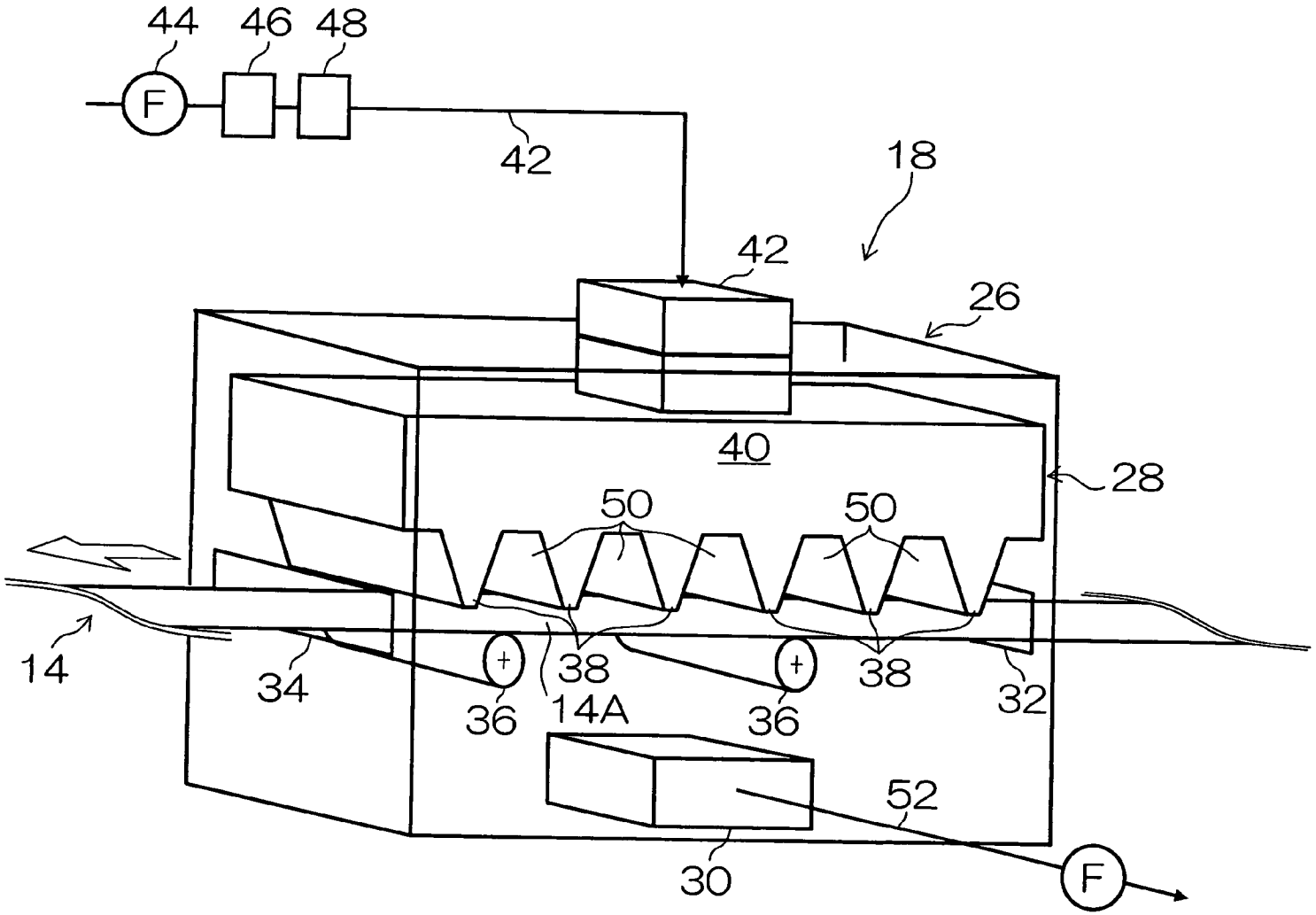
FIG. 2 is a structural diagram illustrating a first embodiment of a drying apparatus of the present invention.

FIG. 2 is a structural diagram showing a first embodiment of the drying apparatus 18 of the present invention.

The drying apparatus 18 comprises a drying apparatus body 26, a hot air blowout section 28 which blows out hot air onto an ink absorption layer 14A applied to and formed on the web 14 and an exhaust section 30 which exhausts the hot air blown out.

Inside the drying apparatus body 26, a tunnel-shaped drying zone through which the web 14 runs from an inlet 32 to an outlet 34 is formed and a plurality of path rollers 36 are arranged in the running line of the web 14.

Figure 3:
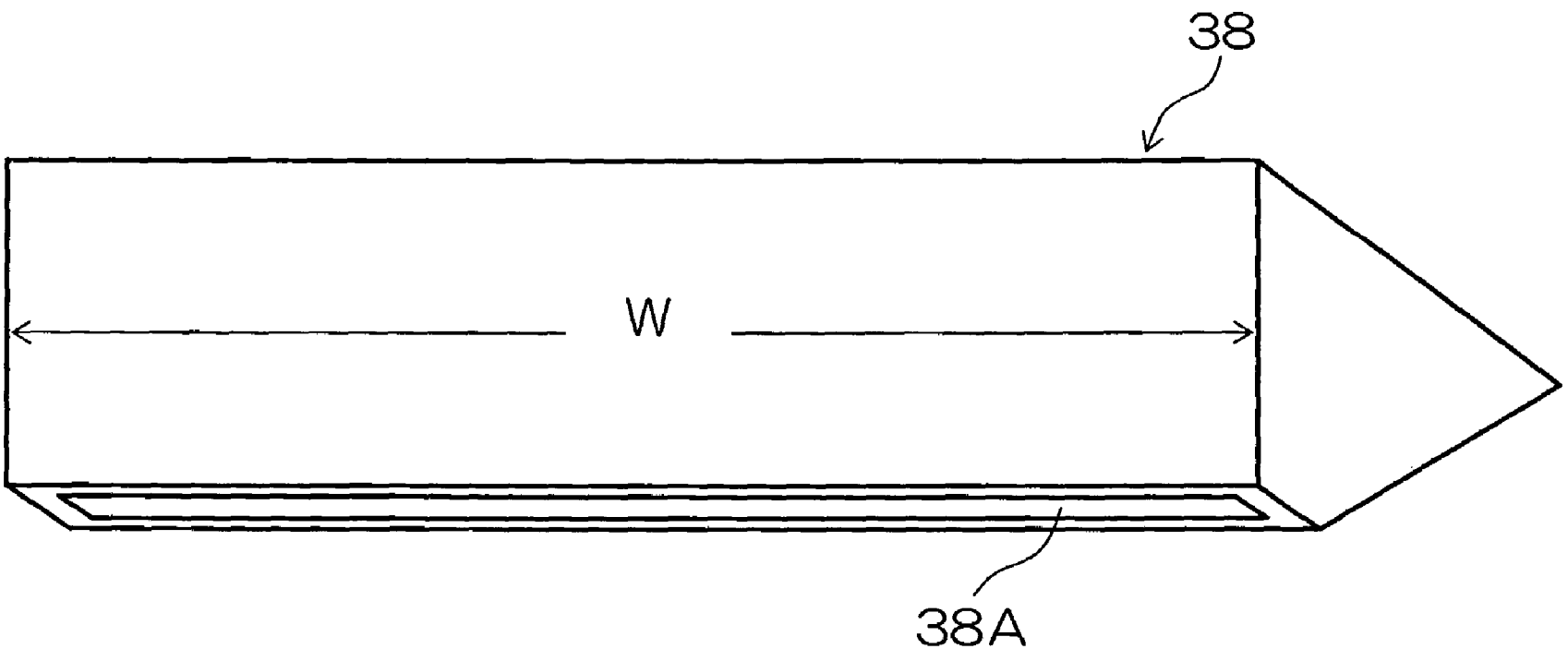
FIG. 3 is a perspective view illustrating a shape of a blowout nozzle.

The hot air blowout section 28 is provided on the ink absorption layer side bordering the web 14 in the drying zone and a plurality of blowout nozzles 38 are arranged from the inlet 32 to the outlet 34 at equal intervals. The blowout nozzle 38 is formed as shown in FIG. 3 in such a way that the length in the web width direction (W) is equal to or slightly greater than the width of the web and a slot-shaped air outlet 38A is formed in the width direction of the web 14. The blowout nozzles 38 communicate with a supply duct 42 through a pressure equalizer chamber 40. The supply duct 42 is provided with a supply fan 44 which intakes fresh air and supplies it to the hot air blowout section 28, a heater 46 which heats the fresh air and a filter 48 which filters dust, etc., of the fresh air. In this way, the hot air supplied from the supply duct 42 into the pressure equalizer chamber is blown out with its blowout pressure equalized from each blowout nozzle 38 onto the film surface of the ink absorption layer 14A. Furthermore, the blowout nozzles 38 protrude from the pressure equalizer chamber 40 in the direction of the ink absorption layer 14A and a space 50 which is recessed from the tip of the blowout nozzle 38 is formed between the neighboring blowout nozzles 38.

On the other hand, an exhaust section 30 which exhausts the hot air blown out of the blowout nozzles 38 is provided opposite the ink absorption layer 14A bordering the web 14 in the drying zone and an exhaust port (not shown) formed in the exhaust section 30 is connected to an exhaust fan 54 through an exhaust duct 52.

Figure 4:
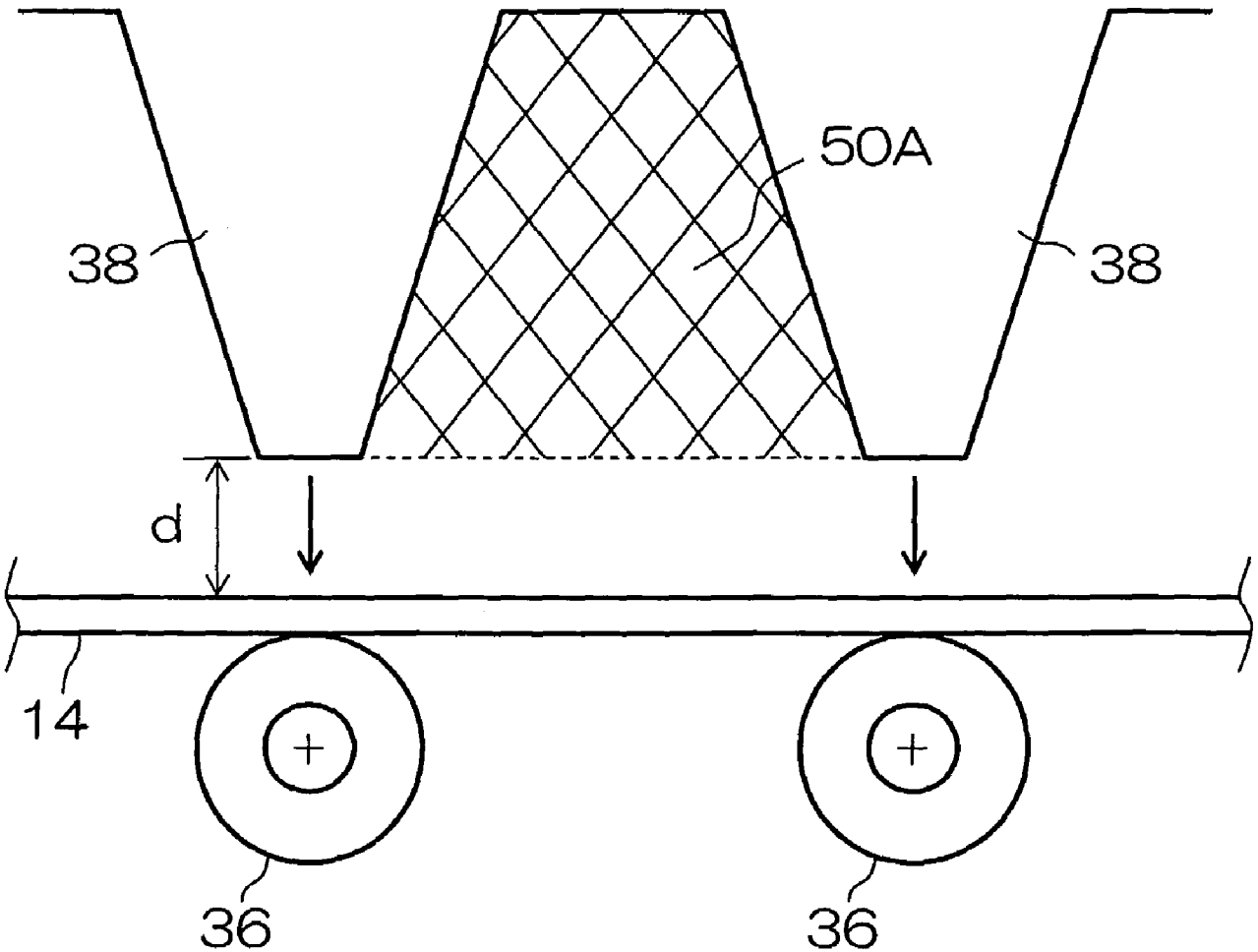
FIG. 4 illustrates a space formed between neighboring blowout nozzles.

In such a configuration of the drying apparatus 18, as shown in FIG. 4, when a longitudinal cross-sectional area 50A (hatching area) viewed from the web running direction of a space 50 which is formed between the neighboring blowout nozzles 38 is S ($m^2$), the amount of hot air blown out of the blowout nozzles 38 is V ($m^3$/min) per 1 m of the length (W) in the web width direction of the blowout nozzles 38, the relationship between the longitudinal area of the space and amount of air is formed in such a way that the value of $(S/V)\times1000$ is 0.5 or above. Furthermore, the distance (d) between the surface of the web 14 and the tip of the blowout nozzle 38 is set to within a range of 10 to 100 mm.

According to the drying apparatus 18 of a first embodiment in the above described configuration, the relationship between the longitudinal cross-sectional area 50A of the space 50 and amount of air is formed in such a way that the value of $(S/V)\times1000$ is 0.5 or above and the capacity of the space with respect to the amount of air blown out of the blowout nozzle 38 is set to a certain value or above, and therefore the hot air which is blown out of the blowout nozzle 38 and collides with the film surface of the ink absorption layer 14A can easily escape into the space 50. This makes the formation of a flow of the hot air escaping toward both ends in the web width direction after colliding with the film surface of the ink absorption layer 14A less likely to occur and even if such a flow is formed, the amount of air decreases. Therefore, the percentage of hot air accumulated at both ends in the web width direction of the web 14 decreases, and therefore it is possible to suppress the drying speed distribution in the web width direction of the ink absorption layer 14A to 20% or less. This allows manufacturing of inkjet recording sheets free of fissures or surface roughness when the ink absorption layer 14A is dried. Indiscriminately increasing (S/V)×1000 will cause a reduction of the drying efficiency or an increase in the size of the drying apparatus body, and for these reasons the upper limit of (S/V)×1000 is inevitably regulated, and therefore the upper limit is not particularly defined here.

Figure 5:
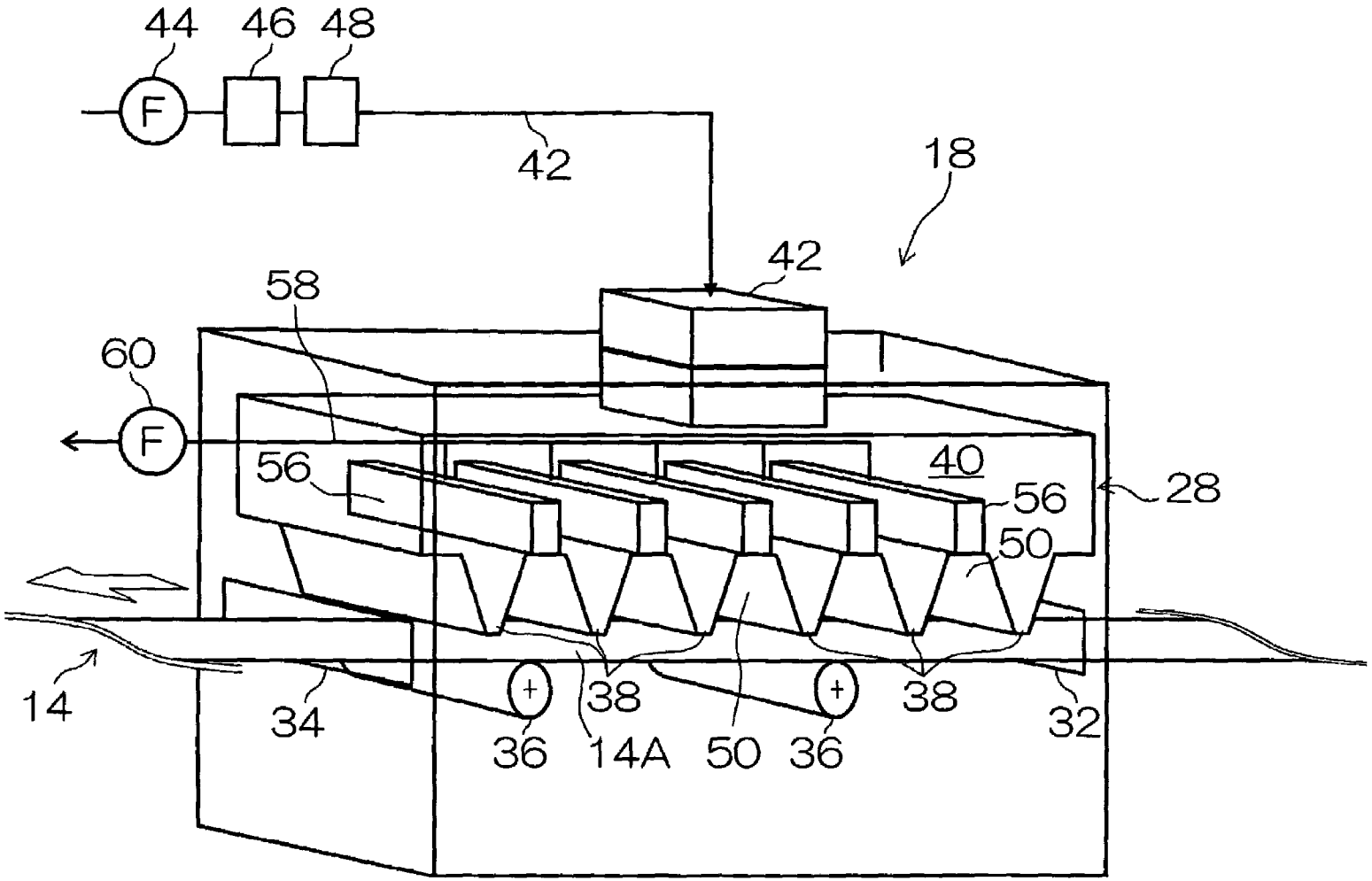
FIG. 5 is a structural diagram illustrating a second embodiment of a drying apparatus of the present invention.

FIG. 5 is a structural diagram showing a second embodiment of the drying apparatus 18. Explanations of the parts which overlap with the explanations of FIG. 2 will be omitted.

The second embodiment of the drying apparatus 18 eliminates the exhaust section 30 shown in FIG. 2 and exhausts the hot air blown out of blowout nozzles 38 from above the film surface of an ink absorption layer 14A and as a preferred mode of exhaust from above the film surface, the hot air is exhausted from a space 50 formed between the neighboring blowout nozzles 38. That is, an intake chamber 56 communicating with the space 50 is provided and each intake chamber 56 is connected to an intake duct 58. The intake duct 58 is provided with an intake fan 60.

According to the drying apparatus 18 of the second embodiment in the above described configuration, the air in the space 50 is exhausted so that induced draft into the space 50 is thereby produced, and therefore the hot air which is blown out of the blowout nozzle 38 and collides with the film surface of the ink absorption layer 14A can escape into the space 50 more easily. This makes the formation of a flow of the hot air escaping toward both ends in the web width direction after colliding with the surface of the ink absorption layer less likely to occur and even if such a flow is formed, the amount of air decreases. Therefore, it is possible to suppress the drying speed distribution in the web width direction of the ink absorption layer 14A to 20% or less. This allows manufacturing of inkjet recording sheets free of fissures or surface roughness when the ink absorption layer 14A is dried.

Figure 6:
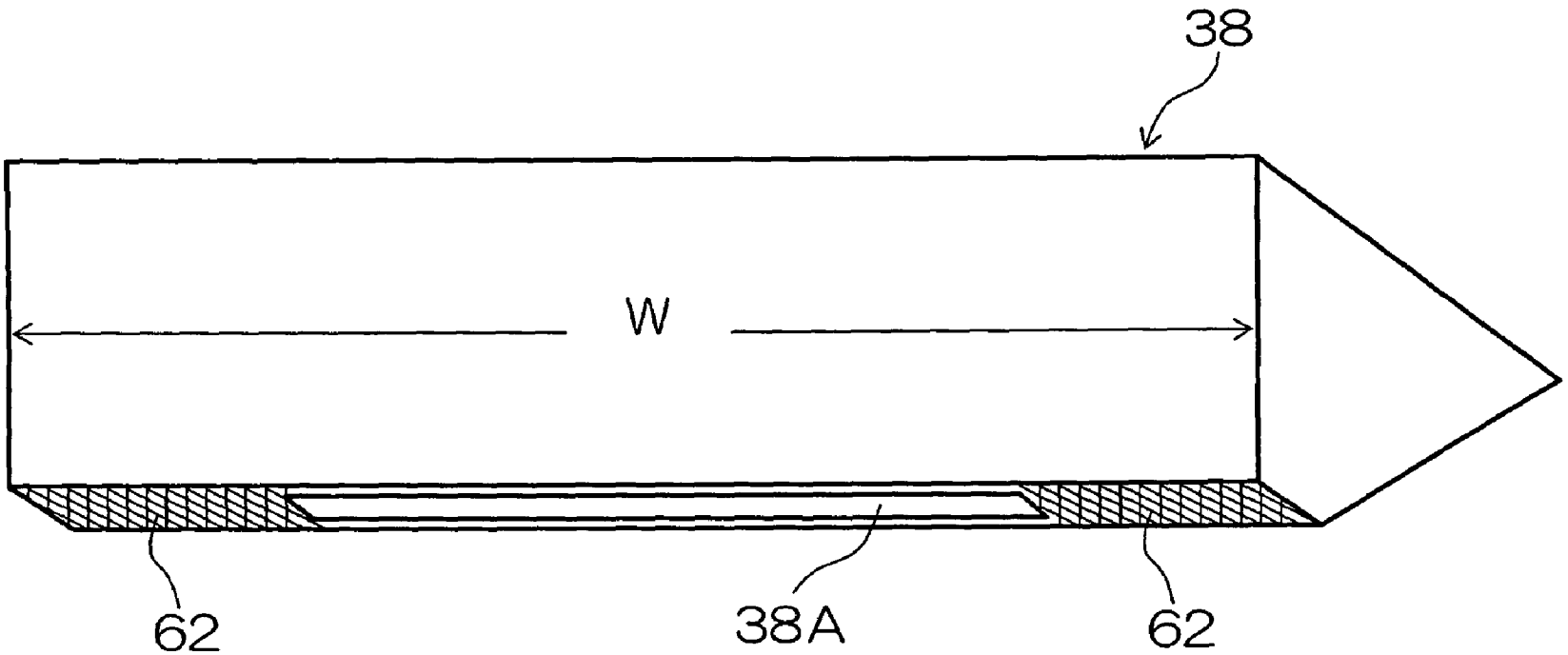
FIG. 6 is a perspective view illustrating a blowout nozzle according to a third embodiment of a drying apparatus of the present invention.

FIG. 6 is a structural diagram showing a third embodiment of the drying apparatus 18. Explanations of the parts which overlap with the explanations of FIG. 2 will be omitted.

Figure 7A:
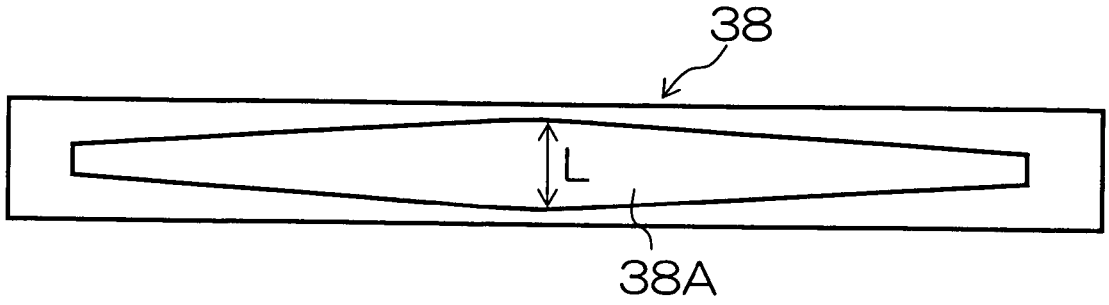
FIGS. 7A and 7B illustrates other modes of the blowout nozzle according to the third embodiment of the drying apparatus of the present invention.
Figure 7B:
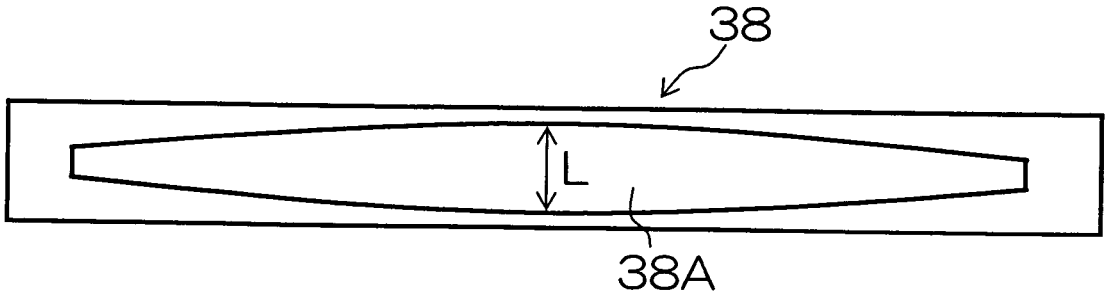

The third embodiment of the drying apparatus 18 is designed so that the area of the opening of a slot-shaped air outlet 38A of a blowout nozzle 38 is smaller at both ends than in the central area in the web width direction and a metal mesh 62 is attached at both ends of the air outlet 38A so that the area of the opening is smaller at both ends than in the central area of the air outlet 38A. In this case, instead of the metal mesh 62, it is also possible to form the opening in such a way that the width (L) of the opening becomes narrower from the central area of the air outlet 38A toward both ends as shown in FIG. 7. FIG. 7A shows a case where the width (L) of the opening is narrowed linearly from the central area of the air outlet 38A toward both ends and FIG. 7B shows a case where the width (L) of the opening is narrowed in a curved form from the central area of the air outlet 38A toward both ends. The extent to which the area of the opening of the air outlet 38A at both ends of the web is reduced with respect to that in the central area can be calculated by measuring the amount of air accumulated at both ends of the web beforehand and determining the area of the opening in such a way that the amount of air blowout is reduced by the amount of air accumulated.

According to the drying apparatus 18 of the third embodiment in the above described configuration, the area of the opening of the slot-shaped air outlet 38A of the blowout nozzle 38 is made smaller at both ends than in the central area in the web width direction, and the amount of air blown out toward both ends in the width direction of the ink absorption layer 14A is made smaller than the amount of air blown out in the central area. In this way, it is possible to reduce a difference in the amount of air between both ends and central area even if hot air is accumulated at both ends in the width direction of the ink absorption layer 14A. This makes it possible to reduce the difference in the drying speed distribution between the central area and both ends in the web width direction of the ink absorption layer 14A and thereby suppress the drying speed distribution in the web width direction of the ink absorption layer 14A to 20% or less. This allows manufacturing of inkjet recording sheets free of fissures or surface roughness when the ink absorption layer 14A is dried.

As described in the first to third embodiments, by adopting any one of configurations for the drying apparatus 18; forming the relationship between the longitudinal cross-sectional area 50A of the space 50 and amount of air in such a way that the value of (S/V)×1000 is 0.5 or above, exhausting hot air blown out of the blowout nozzle 38 from above the film surface of the ink absorption layer 14A and making the area of the opening of the slot-shaped air outlet 38A of the blowout nozzle 38 smaller at both ends than in the central area in the web width direction, it is possible to suppress the drying speed distribution in the web width direction of the ink absorption layer 14A to 20% or less. In this case, combining these two or more configurations can further reduce the drying speed distribution in the width direction of the ink absorption layer 14A.

The case where these configurations are applied to the drying apparatus 18 has been explained but they are also applicable to the drying apparatus 22 which dries a cross-linker application liquid.

This embodiment has described the case where the drying apparatus for an application film of the present invention is applied to manufacturing of inkjet recording sheets, but this embodiment is not limited to the manufacturing of inkjet recording sheets but also applicable to drying of an application film in general.

EXAMPLES

The present invention will be explained using examples, but the present invention is not limited to these examples.

Example 1

An amount of 200 cc/r$^2$ of ink absorption layer application liquid was applied to a photographic laminated sheet (web 14) of 1000 mm in width and 200 μm in thickness running at an application speed of 40 m/min using an extrusion die coater 16 and the ink absorption layer application liquid was dried with hot air blown out of the blowout nozzles 38 of the drying apparatus 18 according to the first embodiment shown in FIG. 2 until the water content in the central area in the width direction in the ink absorption layer 14A became 312 weight percent (amount of water/amount of solid content). Then, a cross-linker application liquid was applied thereto through the second application coater 20 and further dried using the drying apparatus 22 and an inkjet recording sheet was manufactured.

At this time, the hot air blowout section 28 of the drying apparatus 18 was designed in such a way that the longitudinal cross-sectional area 50A of the space 50 formed between the neighboring blowout nozzles 38 was $5.0\times10^{-3}$ m$^2$, the amount of hot air blown out of the blowout nozzles 38 was 9.6 $m^3$/min per 1 m of the length in the web width direction of the air outlet 38A of the blowout nozzle 38 so as to the value of (S/V)×1000 be 0.52. Furthermore, the distance from the surface of the web 14 to the tip of the blowout nozzle 38 was set to 50 mm and the length (W) in the web width direction of the air outlet 38A of the blowout nozzle 38 was made equal to the width of the web 14.

As a result, the drying speed at both ends in the web width direction of the ink absorption layer 14A was 15% greater than the drying speed (minimum drying speed) in the central area, but this fell within the range of the present invention "the drying speed distribution in the web width direction of the ink absorption layer is suppressed to 20% or less." This allowed manufacturing of high quality inkjet recording sheets free of fissures or surface roughness throughout the entire width in the web width direction of the ink absorption layer 14A. Furthermore, no product loss or step contamination occurred.

Example 2

This example is the same as Example 1 except that the amount of air blown out of the blowout nozzles 38 was set to 10.1 $m^3$/min per 1 m of the length in the web width direction of the blowout nozzle 38, the value of (S/V)×1000 was set to 0.50 so as to the ink absorption layer 14A be dried until its water content in the central area in the web width direction became 400 weight percent.

As a result, the drying speed at both ends in the web width direction of the ink absorption layer 14A was 20% greater than the drying speed in the central area, which was the upper limit of the drying speed distribution of 20% or less, and therefore tiny fissures were observed near both ends in the width direction of the ink absorption layer 14A, but it was of a level which would pose no problems with the quality of the inkjet recording sheet.

Comparative Example 1

This example was the same as Example 1 except that the longitudinal cross-sectional area 50A of the space 50 was set to $2.5\times10^{-3}$ $m^2$ and the amount of air blown out of the blowout nozzles 38 was set to 5.1 $m^3$/min per 1 m of the length in the web width direction of the blowout nozzle 38 so as to the value of (S/V)×1000 be set to 0.49.

As a result, the drying speed at both ends in the web width direction of the ink absorption layer 14A was 21% greater than the drying speed in the central area and exceeded the drying speed distribution of 20% or less. This caused large fissures near both ends in the web width direction of the ink absorption layer 14A resulting in a problem with quality. Furthermore, some step contamination due to application film pieces peeled off the ink absorption layer 14A was also observed.

Example 3

An amount of 200 cc/$M^2$ of an ink absorption layer application liquid was applied to a photographic laminated sheet (web 14) of 1300 mm in width and 200 μm in thickness running at an application speed of 50 m/min using an extrusion die coater 16, then this ink absorption layer application liquid was dried using the drying apparatus 18 according to the second embodiment shown in FIG. 5 until the water content in the central area in the web width direction in the ink absorption layer 14A became 400 weight percent. The longitudinal cross-sectional area 50A of the space 50 in this drying apparatus, amount of air from the blowout nozzles 38 and the value of (S/V)×1000 were the same as those in Example 2. Then, a cross-linker application liquid was applied thereto through the second application coater 20, further dried using the drying apparatus 22 and an inkjet recording sheet was manufactured in this way.

As a result, the drying speed at both ends in the web width direction of the ink absorption layer 14A was 13% greater than the drying speed in the central area, but the drying speed distribution was smaller than those in Examples 1 and 2. This is considered-to be attributable to the fact that the two conditions were satisfied; that the value of (S/V)×1000 was 0.50 or above and that the air in the space 50 was exhausted. This allowed manufacturing of high quality inkjet recording sheets free of fissures or surface roughness throughout the entire width in the web width direction of the ink absorption layer 14A. Furthermore, no product loss or step contamination occurred.

In Example 3, the longitudinal cross-sectional area 50A of the space 50 in the drying apparatus 18, amount of air from the blowout nozzles 38 and the value of (S/V)×1000 were made equal to those in Comparative Example 1. That is, this is a case where the air in the space 50 is exhausted but the value of (S/V)×1000 does not satisfy 0.50 or above. As a result, the drying speed at both ends in the web width direction of the ink absorption layer 14A was 16% greater than the drying speed in the central area. As a result, it was possible to manufacture an inkjet recording sheet with no problems with only exhaust from the space 50.

Example 4

In Example 1, when the ink absorption layer 14A was dried until the water content in the central area in the web width direction in the ink absorption layer 14A became 312 weight percent to 400 weight percent, the water content at both ends in the web width direction of the ink absorption layer 14A became 308 weight percent. This is equivalent to a drying speed distribution of 23%, which exceeded the drying speed distribution of 20% or less of the present invention. Therefore, as shown in FIG. 6, the metal mesh 62 was attached up to 100 mm from both ends of the (total) length of 1000 mm in the web width direction of the air outlet 38A of the blowout nozzle 38 so that the ratio of the opening at those parts was 70% of that in the central area (area without metal mesh). Thus, this example is the same as Example 1 except that the ink absorption layer 14A was dried with the velocity of air (amount of air) colliding with both ends in the web width direction of the ink absorption layer 14A reduced.

As a result, the drying speed at both ends in the web width direction of the ink absorption layer 14A was 14% greater than the drying speed in the central area, but using the blowout nozzle 38 in FIG. 6 could reduce the drying speed distribution by 9% satisfying 20% or less. This allowed manufacturing of high quality inkjet recording sheets free of fissures or surface roughness throughout the entire width in the web width direction of the ink absorption layer 14A.

Example 5

The longitudinal cross-sectional area of the space 50 was set to $5.0\times10^{-3}$ $m^2$, the amount of air from the blowout nozzles 38 was set to 9.6 $m^3$/min per 1 m of the length in the web width direction of the blowout nozzle 38 and the value of (S/V)×1000 was set to 0.52. Then, the ink absorption layer 14A was dried until its water content in the central area in the web width direction of the ink absorption layer 14A became 500 weight percent.

Then, the air was exhausted from the space 50, the amount of air from the blowout nozzles 38 was set to 10.1 $m^3$/min per 1 m of the length in the web width direction so as to the value of (S/V)×1000 be set to 0.50. Then, the ink absorption layer 14A was dried until its water content in the central area in the width direction became 400 weight percent.

Conditions other than those described above were made equal to those in Example 1. Then, a cross-linker application liquid was applied thereto using the second application coater 20, dried further using the drying apparatus 22 and an inkjet recording sheet was manufactured in this way.

As a result, the drying speed at both ends in the web width direction of the ink absorption layer 14A was 14% greater than the drying speed in the central area, which satisfied 20% or less. This allowed manufacturing of high quality inkjet recording sheets free of fissures or surface roughness throughout the entire width in the web width direction of the ink absorption layer 14A.

What is claimed is:

1. A drying apparatus for an application film, which dries an application film applied to and formed on a continuously running web with hot air, comprising:

a drying apparatus body which forms a tunnel-shaped drying zone where said web is running from the inlet to the outlet;

a hot air blowout section provided on the application film side bordering said web in said drying zone, including a plurality of blowout nozzles having slot-shaped air outlets in said web width direction arranged from said inlet to said outlet at certain intervals; and an exhaust device which exhausts the hot air blown out of said blowout nozzles from above the surface of said application film;

wherein said hot air blowout section has a space between neighboring blowout nozzles, and wherein at least a portion of the space is adjacent to the tips of the neighboring blowout nozzles.

2. The drying apparatus for an application film according to claim 1, wherein the space is recessed from the tip of said blowout nozzles and air in said space is exhausted by said exhaust device.

3. The drying apparatus for an application film according to claim 1, wherein the distance from the surface of said web to the tip of said blowout nozzles is within a range of 10 to 100 mm.

4. The drying apparatus for an application film according to claim 2, wherein the distance from the surface of said web to the tip of said blowout nozzles is within a range of 10 to 100 mm.

5. The drying apparatus for an application film according to claim 1, wherein the application film comprises an ink absorption layer application liquid containing inorganic particles and water-soluble resin applied to the continuously running webs.

6. The drying apparatus for an application film according to claim 2, wherein the application film comprises an ink absorption layer application liquid containing inorganic particles and water-soluble resin applied to the continuously running web.

7. The drying apparatus for an application film according to claim 3, wherein the application film comprises an ink absorption layer application liquid containing inorganic particles and water-soluble resin applied to the continuously running web.

8. The drying apparatus for an application film according to claim 4, wherein the application film comprises an ink absorption layer application liquid containing inorganic particles and water-soluble resin applied to the continuously running web.

9. The drying apparatus for an application film according to claim 1, wherein the space extends substantially the entire distance between the tips of the neighboring blowout nozzles.

* * * * *